US007073260B2

(12) United States Patent
Jensen

(10) Patent No.: US 7,073,260 B2
(45) Date of Patent: Jul. 11, 2006

(54) KNIFE ASSEMBLY

(76) Inventor: Raliegh J. Jensen, 4419 Federal Way, Boise, ID (US) 83716

( * ) Notice: Subject to any disclaimer, the term of this patent is extended or adjusted under 35 U.S.C. 154(b) by 210 days.

(21) Appl. No.: 10/911,290

(22) Filed: Aug. 3, 2004

(65) Prior Publication Data

US 2006/0027068 A1 Feb. 9, 2006

(51) Int. Cl.
*B26B 3/03* (2006.01)
*B26B 3/04* (2006.01)

(52) U.S. Cl. ..... 30/113.3; 30/114; 30/303

(58) Field of Classification Search ..... 30/114, 30/299–303, 278, 282, 279.2, 113.1, 113.3; 83/662, 402, 932, 856, 858; 99/537–539, 99/542, 545

See application file for complete search history.

(56) References Cited

U.S. PATENT DOCUMENTS

| | | | | |
|---|---|---|---|---|
| 2,509,190 A * | 5/1950 | Langley | 99/545 |
| 3,830,151 A * | 8/1974 | Gerson | 99/537 |
| 5,009,141 A | 4/1991 | Julian et al. | 83/857 |
| 5,095,794 A | 3/1992 | Mendenhall | 83/858 |
| 5,337,480 A * | 8/1994 | Codikow | 30/114 |
| 5,343,623 A | 9/1994 | Cole et al. | 30/304 |
| 5,398,580 A * | 3/1995 | Gerhardt et al. | 83/880 |
| 5,421,249 A * | 6/1995 | Repisky et al. | 99/545 |
| 5,446,965 A * | 9/1995 | Makridis | 30/303 |
| 5,520,105 A * | 5/1996 | Healy | 100/98 R |
| 6,601,491 B1 | 8/2003 | Jensen | 83/62.1 |

* cited by examiner

*Primary Examiner*—Kenneth E. Peterson
*Assistant Examiner*—Phong Nguyen
(74) *Attorney, Agent, or Firm*—Joseph W. Holland; Holland & Midgley, LLP

(57) ABSTRACT

A knife assembly for use in a food cutting apparatus includes a compression ring adapted for threaded engagement with a base ring. The compression ring includes a threaded collar that tapers thinner towards its leading edge. The blade support ring tapers thinner towards a leading edge of the support ring sidewall. The blade support ring includes a sidewall having a plurality of blade second end receiving slots. At least two blades are connected at their first ends to a central cutter element and at their second ends to the blade support ring. As the compression ring engages the base ring, the advancing and opposing surfaces of the tapered sidewall of the compression ring and the tapered sidewall of the blade support ring cooperate imparting a compressive force against the ends of the blades, securing the blade with respect to the compression ring and the cutter element.

11 Claims, 5 Drawing Sheets

KNIFE ASSEMBLY

BACKGROUND OF THE INVENTION

1. Field of Invention

This invention relates to the cutting of food product and more particularly to a knife assembly for cutting food product.

2. Background of the Invention

Devices for cutting food products into slices are well-known in the art and may include an array of cutting knives with a means to propel or impinge the food product through or against the knife array. The food product may be conveyed through a knife assembly by entraining it in a fluid stream. Alternately, the food product may be forced against the knife array by mechanical or other means.

The prior art of food cutting knife assemblies includes both fixed relatively rigid knives, see for instance U.S. Pat. Nos. 5,095,794, 5,009,141, and tensioned blades, see for instance U.S. Pat. Nos. 5,343,623 and 6,601,491. These devices have commonly been employed to cut a food product, typically potatoes into sticks or french fries. While a variety of devices have been demonstrated to be suitable for cutting food product in a stick configuration consumers, nevertheless, prefer that some food product be presented in a different sliced configuration. For instance, apples, melons and other fruits are commonly prepared and presented having a wedge configuration. At least one device has been offered as a solution to cutting food product into wedges. This device includes a plurality of blades radiating outwardly from and welded to a center tubular cutter. The plurality of blades welded about an inner periphery of a ring. Welded knife assemblies are expensive and the entire unit must be replaced when even a single blade is damaged or dulled.

Therefore, advantage may be found in providing a novel device for cutting a food product in a wedge configuration. Additional advantage may be found in providing a device including replaceable blades, for cutting food product into a wedge configuration.

SUMMARY OF THE INVENTION

The present invention is directed to a knife assembly including a plurality of blades, each blade connected at a first end to a core knife and each blade connected at a second end to a blade support ring. The knife assembly includes a base ring and a compression ring adapted for engagement with the base ring. The blade support ring, the base ring and the compression ring each include an aperture through which a food product may be passed. The base ring includes a mounting flange adapted to allow the knife assembly to be mounted in a food product cutting apparatus. The compression ring is adapted to variably or adjustably engage the base ring. Variable or adjustable engagement of the compression ring with respect to the base ring may be achieved by any of a variety of means including mechanical, electro-mechanical, pneumatic or hydraulic. In a preferred embodiment of the invention, the base ring includes a threaded inner wall and the compression ring includes a threaded collar that tapers thinner towards its leading edge. The blade support ring includes a sidewall having a plurality of blade second end receiving slots, the blade support ring configured to taper thinner towards a leading edge of the sidewall. The core knife, the blade support ring and the blades, with the first end connected to the core knife and the second end connected to the blade support ring, are positioned within the aperture formed within the base ring. The threaded collar of the compression ring is engaged with the threaded inner wall of the base ring. As the threads of the base ring and the compression ring are advanced against one another, the advancing and opposing surfaces of the tapered sidewall of the compression ring and the tapered sidewall of the blade support ring cooperate to impart a compressive force against the outer or second ends of the blades, securing the blade with respect to the compression ring and the core knife.

According to one embodiment of the present invention, the knife assembly can be disassembled and the various component parts, including the core knife and the blades may be replaced and sharpened as needed.

The present invention consists of the combination and arrangement of parts hereinafter more fully described, illustrated in the accompanying drawings and more particularly pointed out in the appended claims, it being understood that changes may be made in the form, size, proportions and minor details of construction without departing from the spirit or sacrificing any of the advantages of the invention.

DETAILED DESCRIPTION OF THE INVENTION

Figure 1:
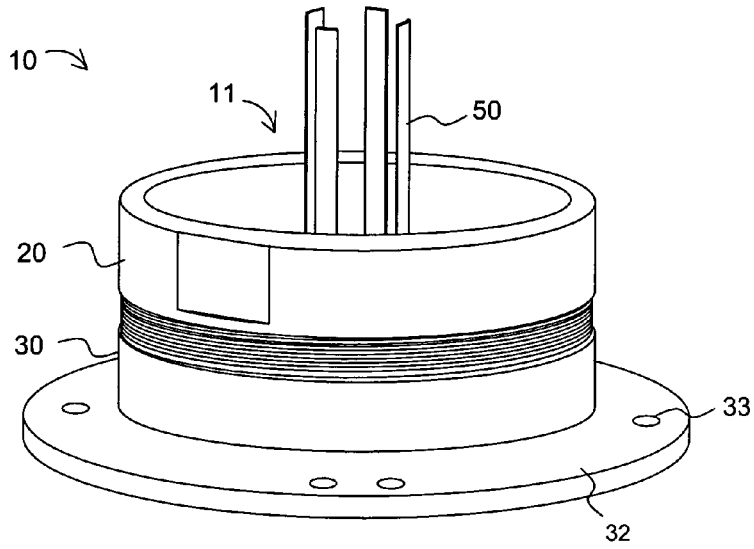
FIG. 1 is a perspective representation of a knife assembly according to one embodiment of the present invention.
Figure 2:
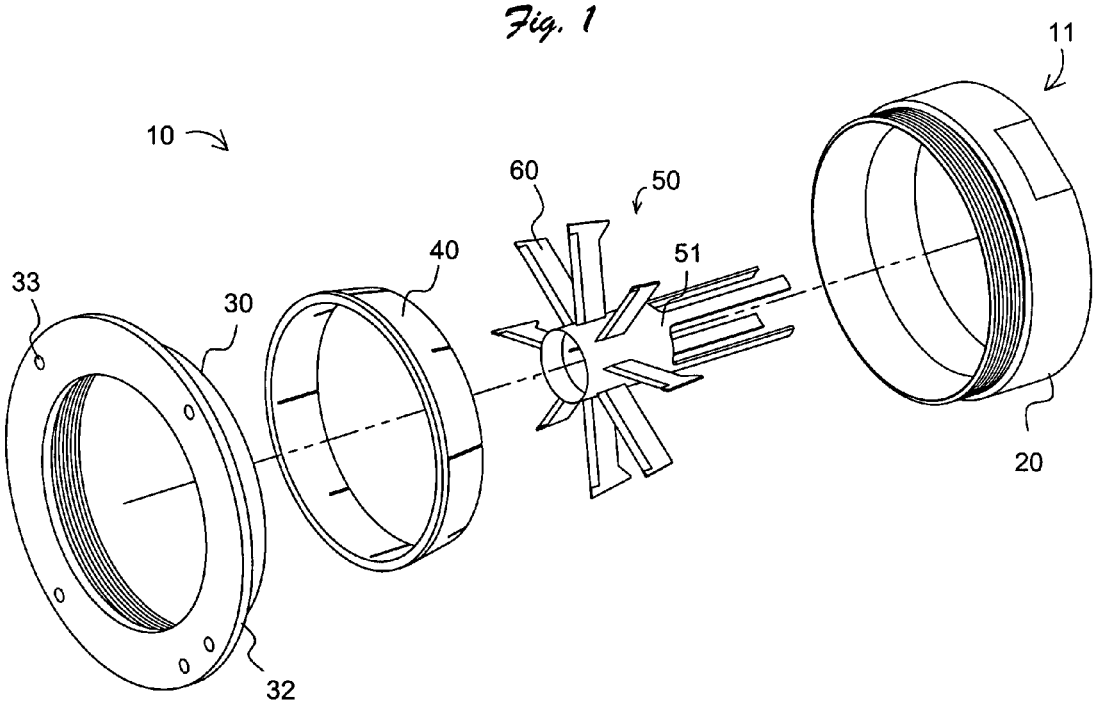
FIG. 2 is an exploded perspective representation of a knife assembly according to one embodiment of the present invention
Figure 5:
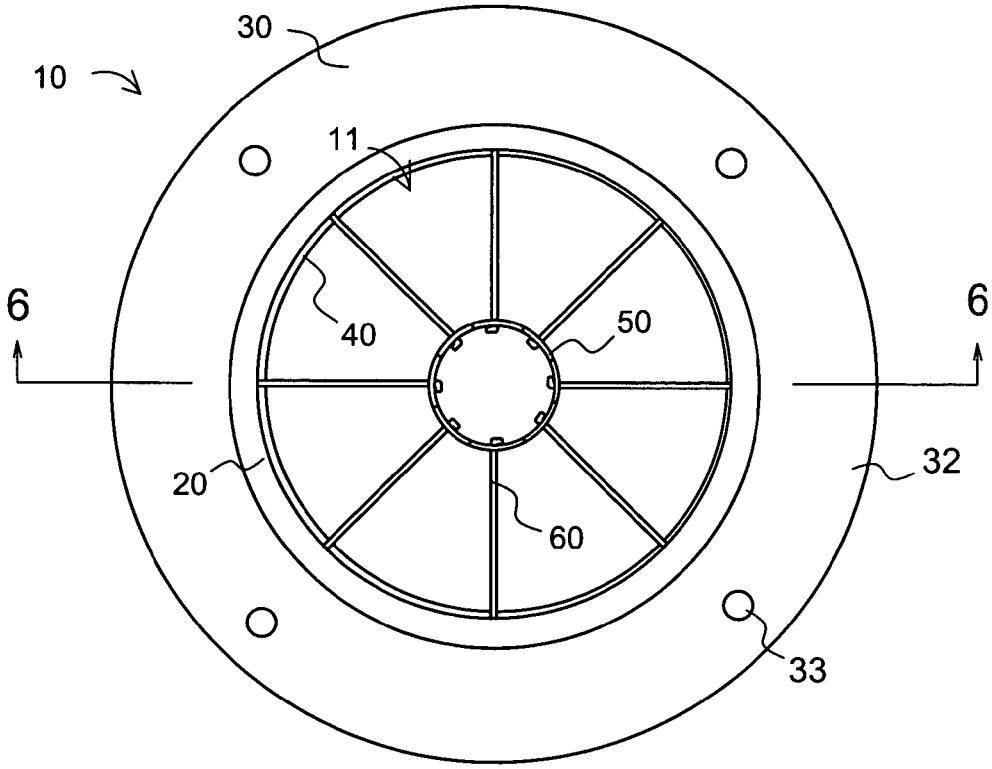
FIG. 5 is a representative top view of a knife assembly according to one embodiment of the present invention.
Figure 6:
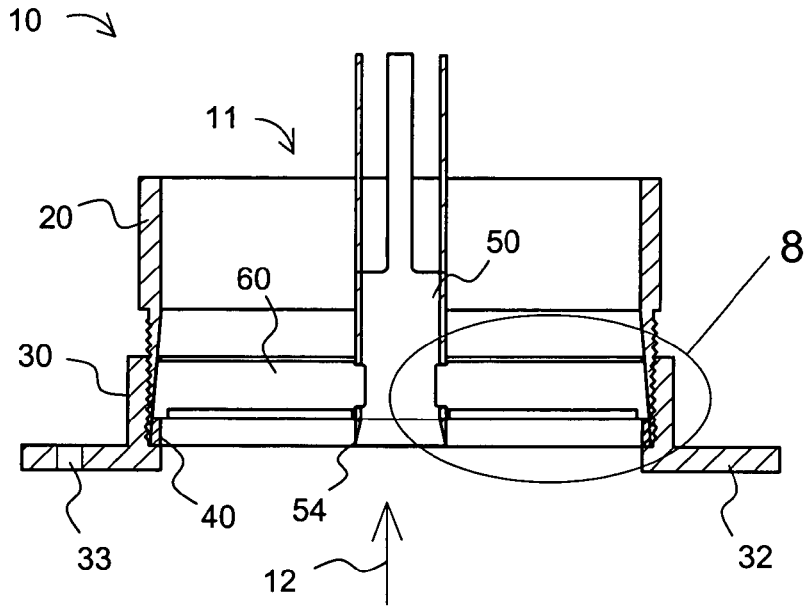
FIG. 6 is a representative side cutaway view of a knife assembly according to one embodiment of the present invention.

Referring to FIGS. 1, 2 and 5–7, a first preferred embodiment of knife assembly 10 for cutting food product, for instance fruits such as apples, is shown to advantage. Compression ring 20 is shown engaging base ring 30. Core knife 50 is positioned within aperture 11 of knife assembly 10. Base ring 30 includes mounting flange 32 having a plurality of apertures 33 formed through a cross-section of mounting flange 32 permitting one or more points of attachment between knife assembly 10 and a cutting apparatus, (not shown). FIG. 2, 5 and 6 show a plurality of blades 60 connected to and extending between core knife 50 and blade support ring 40. The plurality of blades 60 may include two or more blades arranged radially about core knife 50. In the preferred embodiment pairs of blades 60 oppose one another. The plurality of blades 60 preferably equals an even number. The plurality of blades 60 may be stacked in vertical tiers, (not shown), or in the alternative, may be arranged about a common latitude of core knife body 51, as seen in FIG. 2.

Figure 3:
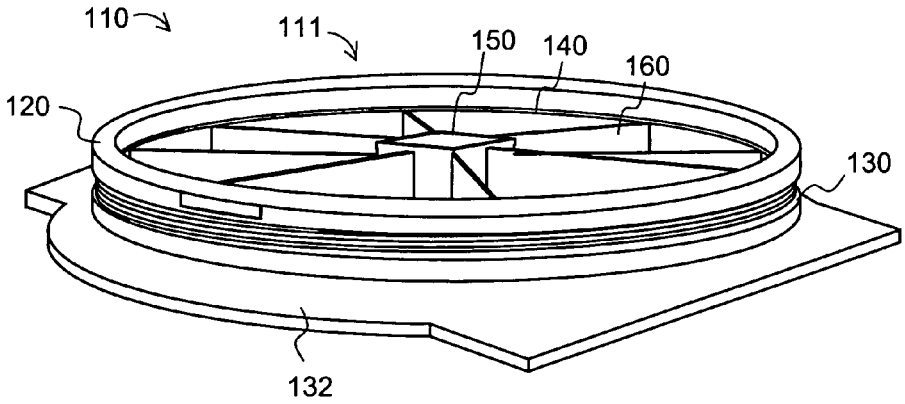
FIG. 3 is a perspective representation of a knife assembly according to one embodiment of the present invention.
Figure 4:
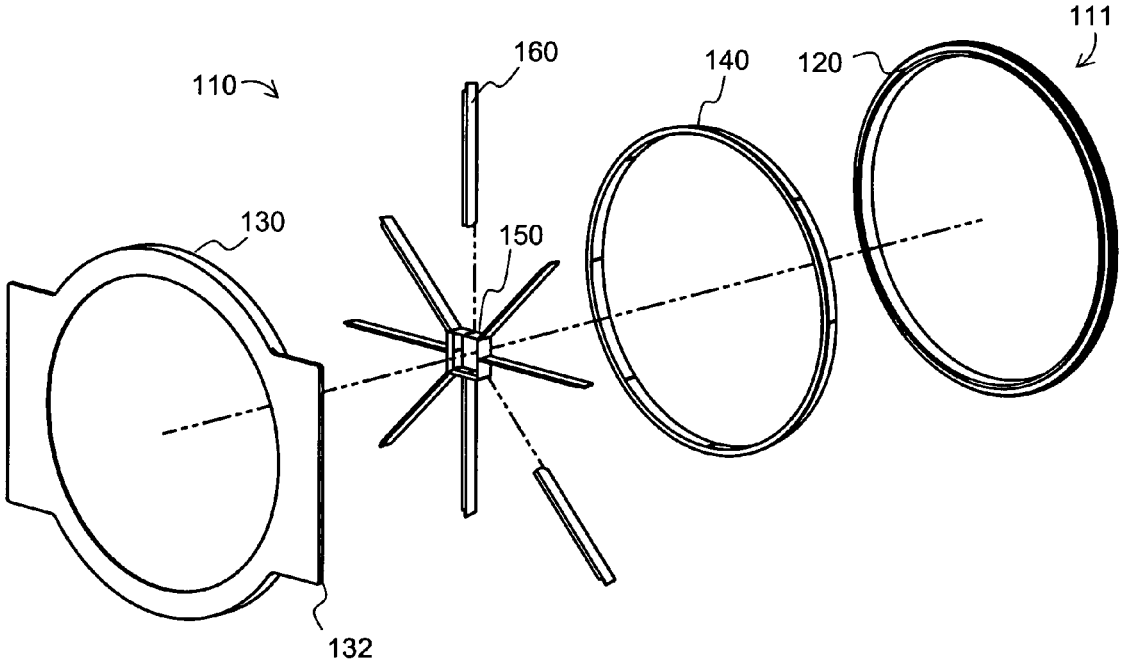
FIG. 4 is an exploded perspective representation of a knife assembly according to one embodiment of the present invention.

Referring to FIGS. 3 and 4 a second preferred embodiment of knife assembly 110 for cutting food product, for instance fruits such as melons, is shown to advantage. Compression ring 120 is shown engaging base ring 130. Core knife 150 is positioned within aperture 111 of knife assembly 110. A plurality of blades 160 are shown connected to and extending between core knife 150 and blade support ring 140. Base ring 130 includes mounting flange 132 attachment of knife assembly 110 to a cutting apparatus, (not shown).

Referring to FIG. 6 as food product, (not shown), is passed through aperture 11 of knife assembly 10 along product vector 12, core knife edge 54 of core knife 50 cuts a core section from the food product while the plurality of blades 60 cut the remaining food product into sliced portions.

Figure 7:
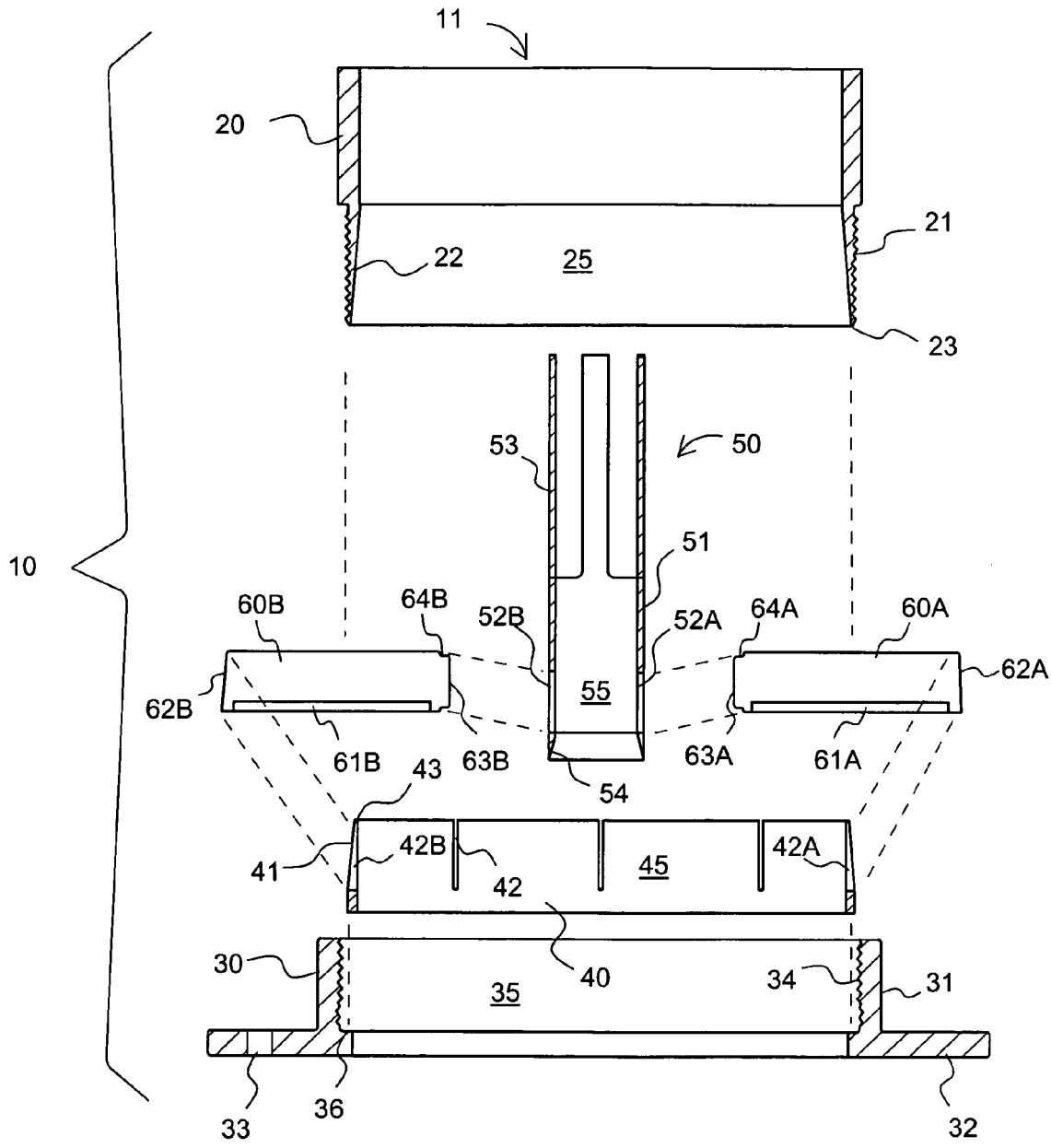
FIG. 7 is a representative exploded side cutaway view of a knife assembly according to one embodiment of the present invention.

Referring to FIG. 7, knife assembly 10 is shown including aperture 11 formed through various component parts of knife assembly 10. Knife assembly 10 includes base ring 30 having a base ring sidewall 31 defining aperture 35. Base ring sidewall 31 includes internal thread 34. Compression ring 20 includes a compression ring tapered sidewall 22 that tapers thinner towards leading edge 23 and defines compression ring aperture 25. Compression ring tapered sidewall 22 includes external thread 21 adapted for engagement with internal thread 34 of base ring 30. Blade support ring 40 is positionable within base ring aperture 35 on land 36. Blade support ring 40 includes tapered sidewall 41 that tapers thinner towards leading edge 43 of support ring tapered sidewall 41. Tapered sidewall 41 includes a plurality of blade receiving slots 42.

Knife assembly 10 also includes core knife 50. Core knife 50 includes a core knife body 51 that includes aperture 55 and slots 52A and 52B adapted to permit insertion of a portion of a blade therein. Core knife 50 may also include a plurality of fingers 53 formed by removal of portion alternating segments of core knife body 51 at a downstream end of core knife body 51 to achieve a reduced drag or friction of a food product with core knife 50 while still providing directional control. As seen in FIG. 7, core knife 50 may also include core knife edge 54 sharpened to facilitate cutting of a core section from the food product.

First blade 60A, including edge 61A, is connected at first end 63A to core knife 50 and at second end 62A to blade support ring 40. Similarly, second blade 60B, including edge 61B, is connected at first end 63B to core knife 50 and at second end 62B to the blade support ring 40. As shown, first end 63A is formed including shoulders 64A. First end 63A is inserted in slot 52 formed in the core knife body 51 of core knife 50. Second end 62A of first blade 60A is connected to blade support ring 40 by placement in blade receiving slot 42A. Second blade 60B is connected to core knife 50 and blade support ring 40 in a like manner. First end 63B is formed including shoulders 64B. First end 63B is inserted in slot 52B formed in core knife body 51 of core knife 50. Second end 62B is connected to blade support ring 40 by placement in blade receiving slot 42B.

Figure 8:
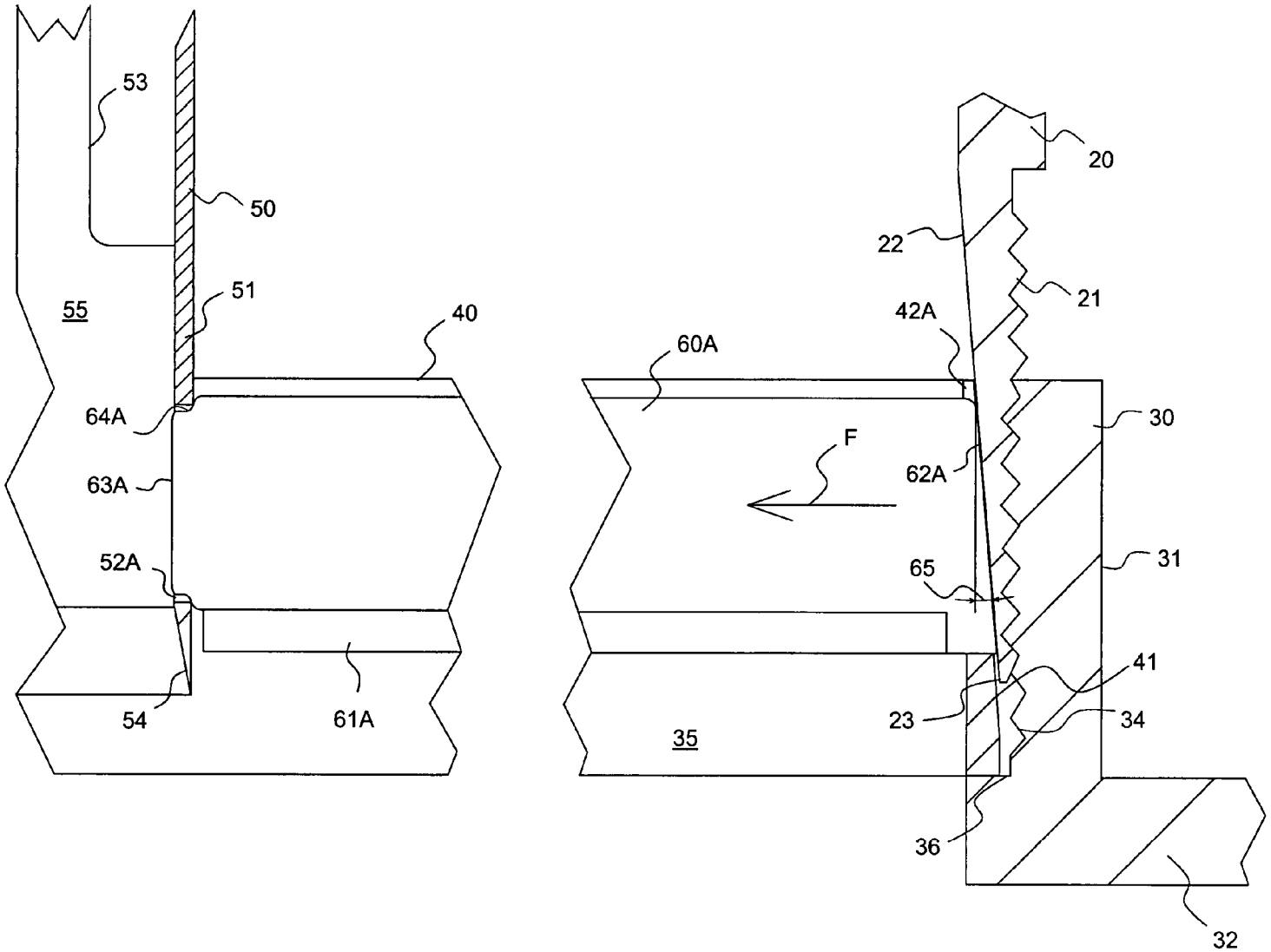
FIG. 8 is a side cutaway detail showing one feature of a knife assembly according to one embodiment of the present invention.

Referring to FIG. 8, a side cutaway detail of a portion of core knife 50, blade 60A and surrounding structure as described is shown to advantage. Base ring 30 is shown including base ring sidewall 31. Base ring sidewall 31 includes aperture 35 and internal thread 34. Compression ring 20 includes a compression ring tapered sidewall 22 that tapers thinner towards leading edge 23. Compression ring tapered sidewall 22 includes external thread 21 adapted for engagement with internal thread 34 of base ring 30. Blade support ring 40 is positioned on land 36. Blade support ring 40 includes tapered sidewall 41. Tapered sidewall 41 includes blade receiving slot 42A.

Also shown in FIG. 8 is a section of core knife 50. Core knife 50 includes core knife body 51, that defines aperture 55 and includes slot 52A adapted to permit insertion of a portion of first blade 60A therein. Core knife 50 may also includes fingers 53. As shown in FIG. 8, core knife 50 also included core knife edge 54 sharpened for facilitating the cutting of the core section of the food product.

First blade 60A, including cutting edge 61A, is connected at first end 63A to core knife 50 and at second end 62A to blade support ring 40. As shown, first end 63A is formed including shoulders 64A. First end 63A is inserted in slot 52A formed in the core knife body 51 of core knife 50. Second end 62A of first blade 60A is positioned in slot 42A of blade support ring 40. As shown in FIG. 8, in the preferred embodiment, second end 62A of first blade 60A includes a taper 65 having an angle substantially equal to the angle of compression ring tapered sidewall 22. As external thread 21 of compression ring 20 engages further with internal thread 34 of base ring 30, the advancing and opposing surfaces of tapered sidewall 41 of blade support ring 40 and tapered sidewall 22 of compression ring 20 impart a force F against second end 62A of first blade 60A, securing first blade 60A with a compressive force with respect to and between compression ring 20 and core knife element 50.

While this invention has been described with reference to the detailed embodiments, this is not meant to be construed in a limiting sense. Various modifications to the described embodiments, as well as additional embodiments of the invention, will be apparent to persons skilled in the art upon reference to this description. It is therefore contemplated that the appended claims will cover any such modifications or embodiments as fall within the true scope of the invention.

I claim:

1. A knife assembly comprising:

a base ring including a base ring sidewall defining a base ring aperture;

a compression ring including a compression ring tapered sidewall defining an aperture, the compression ring adapted for adjustable engagement with the base ring;

a blade support ring positioned within the base ring aperture, the blade support ring including a tapered sidewall, the tapered sidewall including a plurality of blade receiving slots;

a core knife positioned within the base ring aperture;

a first blade connected at a first end to the core knife and at a second end to the blade support ring; and a second blade connected at a first end to the core knife and at a second end to the blade support ring.

2. The knife assembly of claim 1 further comprising:

the base ring sidewall including an internal thread; and the compression ring tapered sidewall including a thread adapted for adjustable engagement with the thread of the base ring.

3. The knife assembly of claim 1 further comprising:

the base ring sidewall including an internal thread; and the compression ring tapered sidewall including an external thread.

4. The knife assembly of claim 1 wherein the core knife further comprises a plurality of slots, each of the plurality of slots adapted to receive a blade first end.

5. The knife assembly of claim 1 wherein the core knife further comprises a sharpened core knife edge.

6. The knife assembly of claim 1 further comprising a plurality of blades, each of the plurality of blades including a first end and a second end, each of the plurality of blades connected at the first end to the core knife and each of the plurality of blades connected at the second end to the blade support ring.

7. A knife assembly comprising:

a base ring including a base ring sidewall defining a base ring aperture, the base ring sidewall including a thread;

a compression ring including a compression ring tapered sidewall defining an aperture, the compression ring tapered sidewall including a thread adapted for adjustable engagement with the thread of the base ring;

a blade support ring positioned within the base ring aperture, the blade support ring including a tapered sidewall, the tapered sidewall including a plurality of blade receiving slots;

a core knife positioned within the base ring aperture;

a first blade connected at a first end to the core knife and at a second end to the blade support ring; and a second blade connected at a first end to the core knife and at a second end to the blade support ring.

8. The knife assembly of claim 1 further comprising:

the base ring sidewall including an internal thread; and the compression ring tapered sidewall including an external thread.

9. The knife assembly of claim 1 wherein the core knife further comprises a plurality of slots, each of the plurality of slots adapted to receive a blade first end.

10. The knife assembly of claim 1 wherein the core knife further comprises a sharpened core knife edge.

11. The knife assembly of claim 1 further comprising a plurality of blades, each of the plurality of blades including a first end and a second end, each of the plurality of blades connected at the first end to the core knife and each of the plurality of blades connected at the second end to the blade support ring.

* * * * *